US012789072B2

(12) United States Patent
Gordon

(10) Patent No.: US 12,789,072 B2
(45) Date of Patent: Nov. 10, 2026

(54) POSITION RECKONING SYSTEM UTILIZING A SPORTS BALL

(71) Applicant: Steven J. Gordon, Weston, MA (US)

(72) Inventor: Steven J. Gordon, Weston, MA (US)

( * ) Notice: Subject to any disclaimer, the term of this patent is extended or adjusted under 35 U.S.C. 154(b) by 1464 days.

(21) Appl. No.: 17/399,638

(22) Filed: Aug. 11, 2021

(65) Prior Publication Data

US 2021/0370152 A1 Dec. 2, 2021

Related U.S. Application Data

(63) Continuation-in-part of application No. 15/629,819, filed on Jun. 22, 2017, now abandoned.

(60) Provisional application No. 62/353,120, filed on Jun. 22, 2016.

(51) Int. Cl.
*A63B 71/06* (2006.01)
*A63B 43/00* (2006.01)

(52) U.S. Cl.
CPC ..... *A63B 71/0605* (2013.01); *A63B 43/00* (2013.01); *A63B 71/0669* (2013.01); *A63B 2220/13* (2013.01); *A63B 2220/20* (2013.01); *A63B 2220/806* (2013.01); *A63B 2220/833* (2013.01); *A63B 2220/89* (2013.01); *A63B 2243/0037* (2013.01)

(58) Field of Classification Search
CPC ... A63B 71/0605; A63B 71/066; A63B 43/00; A63B 2220/12; A63B 2220/20; A63B 2220/806; A63B 2220/833; A63B 2220/89; A63B 2243/003; A63B 2243/0037
See application file for complete search history.

(56) References Cited

U.S. PATENT DOCUMENTS

| | | | |
|---|---|---|---|
| 6,287,225 | B1 | 9/2001 | Touhey et al. |
| 7,094,164 | B2 | 8/2006 | Marty et al. |
| 7,850,552 | B2 | 12/2010 | Marty et al. |
| 7,854,669 | B2 | 12/2010 | Marty et al. |
| 8,517,870 | B2 | 8/2013 | Crowley et al. |
| 8,540,560 | B2 | 9/2013 | Crowley et al. |
| 8,597,095 | B2 | 12/2013 | Crowley et al. |
| 8,951,106 | B2 | 2/2015 | Crowley et al. |
| 9,283,457 | B2 | 3/2016 | Thurman et al. |
| 9,339,710 | B2 | 5/2016 | Thurman et al. |
| 9,486,692 | B2 | 11/2016 | Crowley et al. |
| 9,492,724 | B2 | 11/2016 | Thurman et al. |
| 9,517,397 | B2 | 12/2016 | Thurman et al. |
| 2003/0073518 | A1 | 4/2003 | Marty et al. |
| 2007/0026974 | A1 | 2/2007 | Marty et al. |

(Continued)

*Primary Examiner* — Jeffrey K Wong
(74) *Attorney, Agent, or Firm* — Bachman & LaPointe, P.C.

(57) ABSTRACT

A sports ball and player position reckoning system, comprising instrumentation in either a sports ball on on a player's person that allows one or more players to be electronically located on a playing field or court each time a goal attempt is made. The instrumentation is configured to either fit through the opening of an inflation port of the ball when the fill valve is removed or attached to a player or a piece of player's clothing. The system works in conjunction with a performance monitor system that detects ball interactions with a goal and is used to trigger the system to analyze the ball flight path just prior to the goal interaction. Player position is ascertained through the localization of the initial position of the player at the start of a ball's flight path.

17 Claims, 5 Drawing Sheets

(56) References Cited

U.S. PATENT DOCUMENTS

| | | | | |
|---|---|---|---|---|
| 2012/0029666 | A1 | 2/2012 | Crowley et al. | |
| 2012/0058845 | A1 | 3/2012 | Crowley et al. | |
| 2013/0079906 | A1 | 3/2013 | Crowley et al. | |
| 2013/0095959 | A1* | 4/2013 | Marty | A63B 24/0021 473/448 |
| 2014/0031151 | A1 | 1/2014 | Crowley et al. | |
| 2014/0081436 | A1 | 3/2014 | Crowley et al. | |
| 2014/0135150 | A1 | 5/2014 | Thurman et al. | |
| 2014/0135957 | A1 | 5/2014 | Thurman et al. | |
| 2014/0135958 | A1 | 5/2014 | Thurman et al. | |
| 2014/0135959 | A1 | 5/2014 | Thurman et al. | |
| 2014/0301598 | A1 | 10/2014 | Marty et al. | |
| 2014/0365415 | A1* | 12/2014 | Stelfox | G06K 7/10227 706/21 |
| 2015/0057775 | A1 | 2/2015 | Dong | |
| 2015/0112464 | A1 | 4/2015 | Crowley et al. | |
| 2015/0265897 | A1* | 9/2015 | Gordon | A63B 63/083 473/447 |
| 2017/0065863 | A1 | 3/2017 | Washburn | |
| 2017/0072262 | A1 | 3/2017 | Crowley et al. | |
| 2017/0128814 | A1* | 5/2017 | Lanni | H04W 4/029 |

* cited by examiner

POSITION RECKONING SYSTEM UTILIZING A SPORTS BALL

CROSS-REFERENCE TO RELATED APPLICATIONS

This application is a Continuation-In-Part of U.S. patent application Ser. No. 15/629,819, filed Jun. 22, 2017, which claims the benefit of U.S. Patent Application Ser. No. 62/353,120, filed Jun. 22, 2016.

BACKGROUND

The present disclosure relates generally to automated systems and method for measuring, recording, recalling and displaying results from attempted shooting at a goal on a sports playing field or court for one or more players. More specifically, the present invention relates to systems and methods that utilize wireless transmitters and receivers in addition to electronic sensors to locate and identify sports balls and players on a sports playing field or court and collect shooting statistics for such players at various locations.

The present invention relates to a sports game performance tracking system that utilizes an optional instrumented (active electronic or passive RF-reflective) sports ball, a performance monitor on or in the vicinity of the goal and one or more antennae placed around a court or playing field to electronically localize shooters (players) and determine the location where a shot was taken and whether the shot resulted in a goal. Data is recorded for the purpose of monitoring, archiving and subsequent review.

In sports games, such as basketball, monitoring a player's skill level and improvements in making goals has typically been manually tracked and documented. Skills coaching could only be accomplished if the coach was present during a practice session or game or by viewing a lengthy video recording. A practice session may be drills, exercises, scrimmages, etc. that occur outside of a formal game. Previously described systems have utilized a variety of sensor means to monitor shots taken, goals missed and goals made, however, they have not included an easy-to-use, cost-effective system that automatically locates players on a court, nor are they able to simultaneously monitor a plurality of balls and players on the court.

When collecting statistics for a sports game such as number of goals and misses when shooting a sports ball, it may be desirable to calculate such statistics at various locations across a court or playing field. By "shot" or shooting," we mean the propelling of a sports ball towards a goal. For basketball, shooting data is often displayed in a "Shot Chart," which consists of a graphical picture of a half basketball court with various numbers or colored regions indicating shooting percentages across court locations. Shot Charts constructed from a significant number of shot attempts may be used to discover the areas on a court where one or more players have high success or low success in making a goal. It should be noted that the term "court" as used throughout this document is intended to mean any type and size of sports playing field, rink, pool, arena, court, etc. Shooting statistics for particular court locations during shooting practice drills may be collected without manual intervention by either of two methods: 1) deterministic—instructing a known player to shoot from one or more specified locations prior to starting such statistics collection or 2) reckoning—measuring the player's or ball's location on the court while shooting is underway. Ideally, when multiple players are on the court, statistics collection also includes determining the identity of the player that is shooting the ball. The reckoning method has advantages over the deterministic method because 1) it gives players more freedom to take practice shots from whatever positions players desire without prescriptive assignments and 2) it may be used during a game or scrimmage practice in addition to shooting drills.

A number of methods have been described to locate one or more players and game balls on a court including machine vision (for example U.S. Pat. No. 7,854,669), motion sensing (for example U.S. Pat. No. 8,540,560), radio frequency transmission (www.quupa.com and Ianni US 2017/0128814 A1), ultrasonic echolocation, radar, optical (laser or LED) radar, etc. Electronic location of a player on a basketball court in order to collect shooting statistics requires an accuracy of a fraction of a meter; however, in order to electronically detect a goal by localization of a ball, wherein a ball passes through a hoop, the accuracy must be closer to about 5 or 10 cm. For accurate real-time ball tracking, not only does the electronic location technology have to be accurate in three dimensions, but data needs to be collected at a relatively high rate in order to not miss fast events, like the ball passing through the rim and net without touching the rim (a "swish" shot). Thus, the volume of the 3D location data may become large, especially when multiple players and multiple balls are utilized. When used in conjunction with a performance monitoring system, such as the one described in U.S. application Ser. No. 14/662,419, reckoning-based systems may be simplified and have a lower spatial resolution and a lower sampling frequency to obtain the desired results, since the result of a shot (goal or miss) may be determined by the performance monitoring system rather than the ball position reckoning (ball localization) system. In certain circumstances, where only the initial position for a shot is desired, it may be sufficient to collect 2D data in a plane parallel to the court rather than full 3D data, further simplifying data collection, reduction and analysis.

Previously described methods for locating players on a court require either a complex machine vision system to analyze images of the field or court from multiple perspectives (for example Sportvu—www.stats.com) or require players to wear a transponder on their person (www.quupa.com and US 2017/0128814 A1) that is sensed by a plurality of facility-installed sensing transponders. These are generally useful systems for continuously tracking players during an entire practice session or game playing period. We propose a way to simplify the determination of one or more players' locations on a court for the sole purpose of locating each player's position just prior to a shot, thereby allowing the calculation of shooting statistics at various locations on a court. The proposed system also allows for tracking multiple shooters who are simultaneously on the court.

SUMMARY

The objective of the current invention is to automatically localize (measure the position of) one or more players' shooting position and performance at different locations on a court. It accomplishes this by utilizing either 1) one or more instrumented balls that may be electronically located across a court at recorded times (an electronic ball position reckoning system) or 2) one or more instrumented player tags that may be electronically located across a court at recorded times (an electronic player position reckoning system) in conjunction with a sensor system (performance monitoring system) that measures ball/goal interactions as well as the time at which such events occur. In the case of basketball, the term "ball/goal interaction" is intended to mean a ball bouncing off a rim and not passing through, a ball colliding or just glancing off the backboard, a ball going through the rim after bouncing off the rim and/or the backboard or a ball "swishing" through the rim without touching either the backboard or the rim. The term "ball/goal interaction" for other sports games may have analogous meanings. The term "performance monitoring system" as used herein means a sensor-based system that can detect ball/goal interactions in the absence of video capture and analysis. Were video capture and analysis used in conjunction with a ball or player reckoning system, there would be no need to use it to detect a ball/goal interaction, as the video could just be analyzed to determine the time of a shot being released from a shooter's hands in order to know the time corresponding to the shooter's shot being taken. The use of a non-video performance monitoring system as described herein is a significant simplification, as it may be a vibration sensor hung on the net to detect ball/goal interactions and need not have a camera pre-positioned on the court and complex video image analysis software to determine what actions are occurring at each video frame. In practice, the performance monitoring system has additional computation and sensing features to independently determine whether a shot was a "make" or a "miss" as well as a clock to accurately measure the time of the ball/goal interaction.

When a ball/goal interaction is detected and the time of such interaction recorded by the performance monitoring system, the data generated by the electronic ball tracking system is analyzed for only relatively recently collected data points in order to locate the origination of a shot. In addition to instrumentation that allows balls to be tracked on a court, the electronic ball position reckoning (ball localization) system within each ball may transmit a unique identifier for that ball, so multiple balls may be simultaneously located. Similarly, the electronic player position reckoning (player localization) system within each player-worn tag may transmit a unique identifier for that player, so multiple players may be simultaneously located. In the case of ball localization, when multiple players are shooting, each player is assigned to a different ball; thus, as long as players use their assigned ball, ball identity and locations at the start of a shot may be determined and through association, the identity of a particular player and the player's location at the beginning of a shot are also known. In order to make sure multiple players do not use one another's ball, the balls are marked on a portion of or over their entire exterior with an easily identifiable marking or badge such as alphanumeric characters, graphical symbols, moniker, textures, or color patches.

In a preferred embodiment, a ball or player position reckoning (localization) system is a radio-frequency-based (RF) 3D location system such as those sold by Apple (www.apple.com/airtag), Decawave (www.decawave.com) and Quuppa (www.quuppa.com) or an RF radar system such as monopulse systems or those sold by Analog Devices (www.analog.com) or RFbeam Microwave GmbH (www.rf-beam.ch). These systems typically use one or more antennae, transmitter/transponders or locators positioned around a court that pick up RF signals from either a transmitter/transponder or "tag" in or on an object to be tracked or reflected signals from the object. The one or more locators communicate with a remote computational system that uses the collected data to calculate the 3D location of the object being tracked through multilateration from multiple antennae or directly from just individual antennae. As used herein, a "remote computational system" can mean a computer, a tablet, a smart phone or other mobile device and these terms are used interchangeably herein. In the case of the Apple Airtag system, or similar Ultra-Wide Band (UWB) systems, both the locator and remote computational system are located within certain mobile devices (for example iPhone model 12). In such systems, mobile devices may directly measure the distance and direction of tags in three-dimensional space relative to the mobile devices. When used as a ball or player positioning system, a single mobile device is sufficient to measure positions on a court as long as the system has been calibrated to the court location. By using multiple tags that have a unique identification signal, that is, they each transmit a unique code along with their locating beacon signal, multiple objects may be simultaneously tracked.

For the case of a ball position reckoning (localization) system, outfitting a game ball with wireless electronic sensors, tags and other devices is well known in the art (for example U.S. Pat. Nos. 6,287,225, 8,517,870, 9,283,457). The present invention utilizes a game ball that incorporates an RF tag, a microprocessor, an energy source such as an energy-harvesting generator or energy storage system (battery or capacitor), and optionally additional sensors, switches etc. It should be noted that in some embodiments, no sensing elements within the game ball are required in order to track the ball on a court, only an RF transmitter/transponder (tag). To conserve power, the microprocessor and radio transmitter may be put into sleep mode when not in use. A motion detection system (such as a switch that closes or opens a contact in response to vibration or tilt—such as RB-231X2 from C&K Components, Newton, MA) may be used to help wake and activate the system. Such switches consume very little or no power to detect when the ball is likely in motion.

For the case of a player position reckoning (localization) system, tags are more accessible, so recharging or replacing batteries may be simpler than for ball position reckoning systems. Tags may be attached anywhere on the player's person, but in a preferred location, the tag would be clipped to the shoelaces of one of the shoes of a player. It is preferable that there be a firm attachment to multiple laces and a minimal amount of tag flopping around on the shoe be permitted. Placing it on the upper side of the shoe maximizes the change of an unobstructed line of sight between the mobile device and the tag, as the radio signals would rarely need to pass through the player's torso.

In currently available UWB systems, the mobile device and tag must exchange discovery tokens to be connected with one another. This should happen automatically when a tag is brought within the range of a mobile device. This establishes the identity of the tag, which may be associated with a particular player and initiates the tracking of the tag.

For the game of basketball, once a player releases a ball for a shot, the ball traces a ballistic parabolic arc within a vertical plane until it impacts an object such as the basketball rim, backboard, floor, another player, etc. In certain embodiments, the present invention utilizes the detection of a ball/goal interaction by the performance monitoring system to trigger the measurement of the ball's path including the initial ball position in the ballistic arc. By locating the position where the arc was initiated, the location of the player on the court may be inferred without the need for extraneous wearables on the player.

Alternatively, the player position reckoning system of the present invention utilizes the detection of a ball/goal interaction by the performance monitoring system to trigger the measurement of the player's position and path (trajectory) just prior to the ball/goal interaction. By tracing the player's location back in time, the location of the player on the court may be inferred at the time the ball was released by the player.

In another embodiment, the start of the ballistic flight of the ball may be calculated in two dimensions rather than in three dimensions by projecting all of the 3D points found by the ball localization system into a horizontal plane. Since during the ball's flight there are no horizontal accelerations (only the vertical acceleration of gravity), the ball has a constant velocity in the horizontal plane during its flight. Even if there is some air resistance or other aerodynamic effects that slightly alter the ball's path from a pure parabolic, in practice the ball velocity in the horizontal plane is close to a constant. Thus, the initial location where the ball starts its ballistic path is the first point whose horizontal speed is approximately the same as the horizontal speed of the other points in the path. Although Doppler-radar-based 3D reckoning systems measure speed, most others only measure position, not speed. For those systems, speed must be calculated by subtracting the position of two adjacent points and dividing by the difference in time that the points were measured.

The systems in the prior art that describe electronics within various balls require that balls be manufactured with the components sealed within the ball. Thus, users must purchase specialized balls that include the sealed components within the ball exclusively from the manufacturers of the specialized balls. This approach limits the market for such products, as many teams and individual athletes have a particular ball brand with which they exclusively play. This may be either dictated by rules of an affiliated organization or by personal or coach preference. It would be highly advantageous if the balls to which players are accustomed could either be instrumented with either the electronics to perform the desired function or an RF-reflective system. In the current invention, we describe a method for instrumenting any inflatable ball, old or new, with the electronics and/or reflective properties necessary to perform the ball tracking and identification functions.

In another embodiment, one or more player position reckoning systems rather than a ball position reckoning system is utilized in conjunction with a performance monitor on or in the vicinity of the goal. In this embodiment, a player is tracked on the court and his/her position is captured just prior to the detection of a ball/goal interaction in order to determine the player's shooting location.

In yet another embodiment, a player position reckoning system with one or more player-worn RF tags are utilized with only a single RF transponder that measures each tag's direction and range in order to locate a player's shooting position on the court. In this embodiment, the position of the single RF transponder needs to be initially calibrated to the court location.

Other details of the invention are set forth in the following detailed description and the accompanying drawing wherein like reference numerals depict like elements.

DETAILED DESCRIPTION

Figure 1:
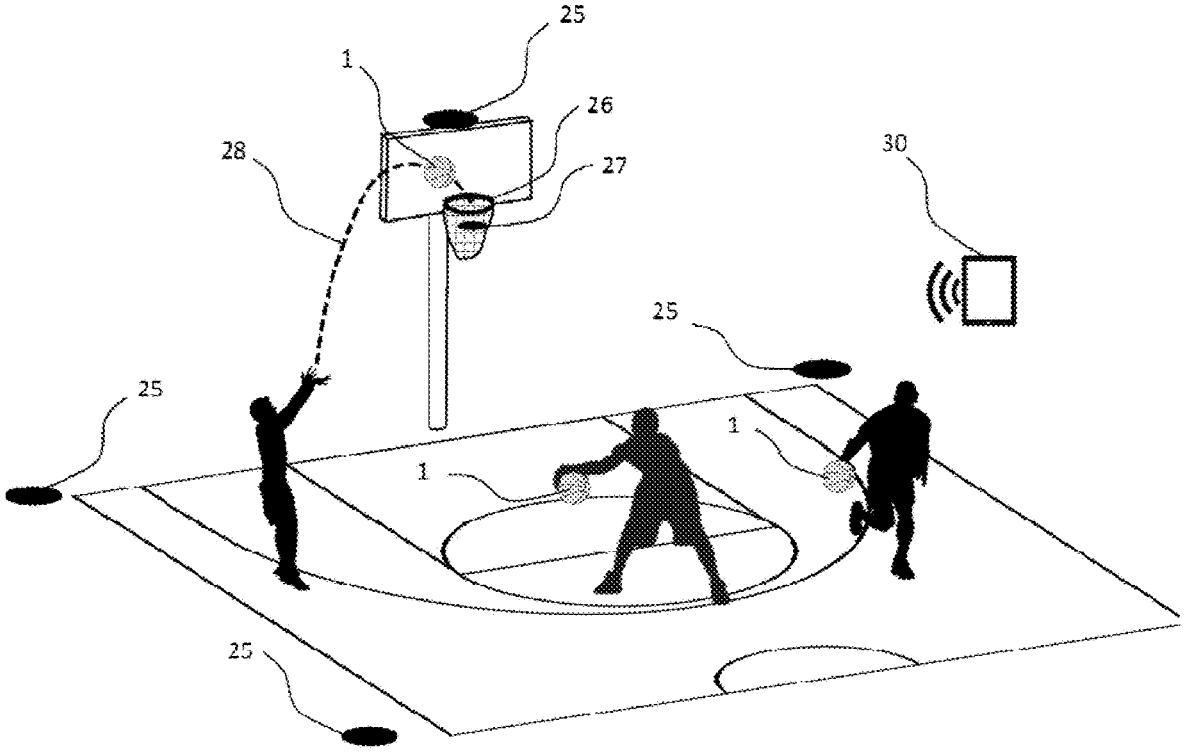
FIG. 1 shows an embodiment of an exemplary performance monitoring and player location reckoning system with a plurality of players and balls on a half basketball court.
Figure 2:
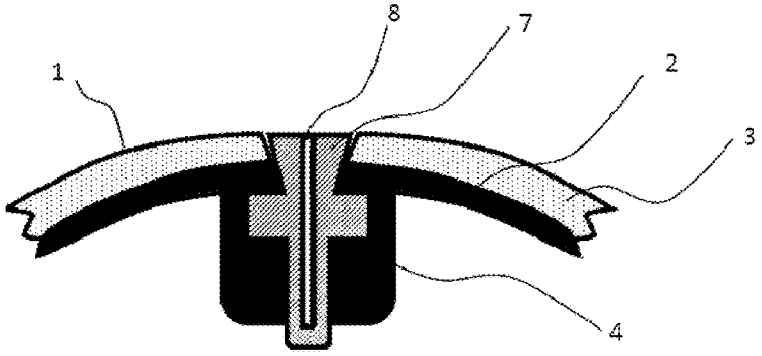
FIG. 2 shows a cross section of an exemplary construction of a portion of a sports ball in the vicinity of the inflation valve.

Many sports balls are air-inflatable and constructed with multiple layers. Generally, these balls consist of an outside layer 3 that is designed to directly interact with a player and promote good grip, bounce, spin, wear, etc. There is also typically an impenetrable inside layer which serves as the bladder 2 for containing the pressurized air. There may optionally be additional layers to increase strength, stiffness, etc. of the inflated ball.

The bladders 2 of inflatable sports balls 1 typically have a thicker valve retention section 4 that is shaped to capture a valve 7, which is used for inflating and deflating the ball with the insertion of a needle 20 through a hole 8 in the valve 7. Valves 7 in sports balls 1 fail fairly frequently and may create a "leaky" ball that loses pressure; thus, standard valves 7 are used throughout the industry and replacement valves are readily available (Tachikara USA, Inc., Sparks, NV, USA). The standard valve 7 is comprised of a top portion that includes a hole 8 for insertion of an inflation needle 20, a disc-shaped center portion that both seals the interface between the valve 7 and bladder 2 so air will not escape and locates the valve 7 in the valve retention section 4 and a cylindrical bottom section with a hemispherical end, which closes and seals itself after an inflation needle 20 is removed.

In one embodiment of the current invention, a low-profile electronics package 5 is attached to a valve 7 and inserted into the valve retention section 4 of a ball 1. The recent advent of miniaturized electronics and RF components have enabled this "aftermarket" instrumentation of a ball, wherein the old valve is removed from any inflatable ball that utilizes a standard valve and then replaced with the new valve that incorporates the low-profile electronics package 5 or reflective system. Other prior-art descriptions of instrumented balls require that balls be manufactured with instrumentation within the bladder 2 and do not contemplate instrumentation insertion into a conventional ball. By combining the universality of standard valve design in inflatable balls throughout the industry with the miniaturization of an RF tag and other electronic components, the present invention is unique as it may be used in almost any inflatable sports ball that has ever been manufactured. Thus, players that have a strong preference for a particular brand, model or individual ball may still get the benefits of an instrumented ball. An additional advantage to the low-profile package is that the system may be disassembled and reassembled in order to change batteries. Thus, the life of the product may be much longer than a system that has permanently sealed batteries inside the inflation bladder.

In one embodiment of the current invention, the electronics package 5 is comprised of a tube 10 which encases the electronics and is attached to the cylindrical bottom section of the valve 7. It should be understood that although the vessel that encases the electronics is referred to herein as a tube, it may be a vessel of any shape, material and size as long as it will fit thought the valve retention section 4 and attach to the valve 7. If a potting compound 18 is used to encase the electronics, the tube not be necessary if the potting compound attaches directly to the valve 7. Within the tube 10, there is an empty channel 11 to accept the needle valve 20 and allow air coming through the needle valve outlet ports 21 to escape through a hole 12 into the bladder interior, a circuit board 14 (which may be rigid or flexible), one or more batteries 13, generators or supercapacitors, various electronic components 16 and an RF chip antenna 17 (such as model number AH-086M555003 from Taiyo Yuden Co. Ltd., Tokyo, Japan) to transmit and receive RF signals. One or more contact buses 15 that connect multiple batteries to one another may also be present. The entire tube and electronics assembly may be optionally potted with a potting compound 18 to create a solid package that is more resilient to the high accelerations and jerks that are inherent in the use of a sports ball 1.

In another embodiment, the ball may be made more reflected to RF transmission by placing a coating or material layer within the ball on the interior of the bladder 2, interior or exterior of the outer layer 3 or between other layers of the ball. Such coating or layer may be comprised of metal powders or other materials that can enhance RF signal reflectivity.

Figure 3:
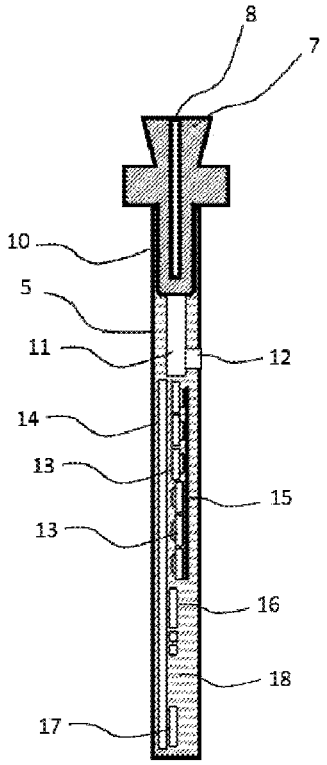
FIG. 3 shows a cross section of an exemplary embodiment of a low-profile electronics package that fits through the valve hole in a sports ball.
Figure 4:
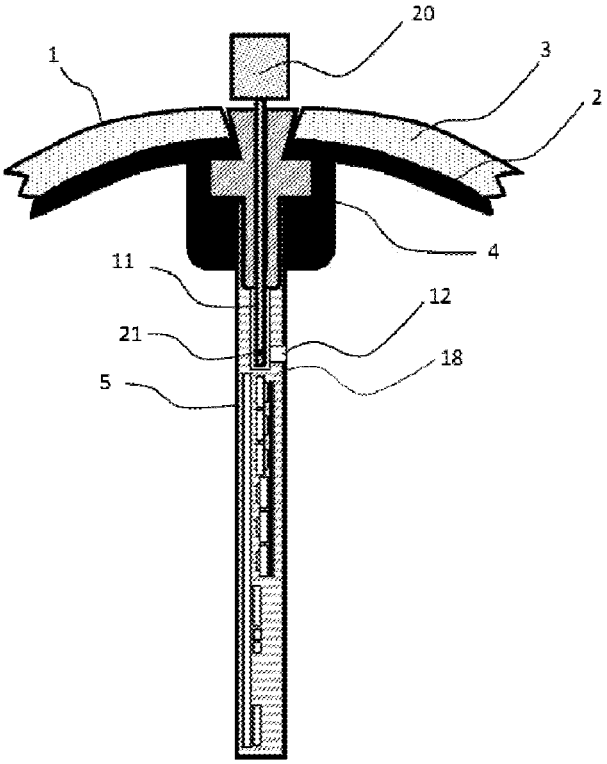
FIG. 4 shows a cross section of an exemplary embodiment of a low-profile electronics package fitted in the valve hole in a sports ball with an inflation needle inserted.
Figure 5:
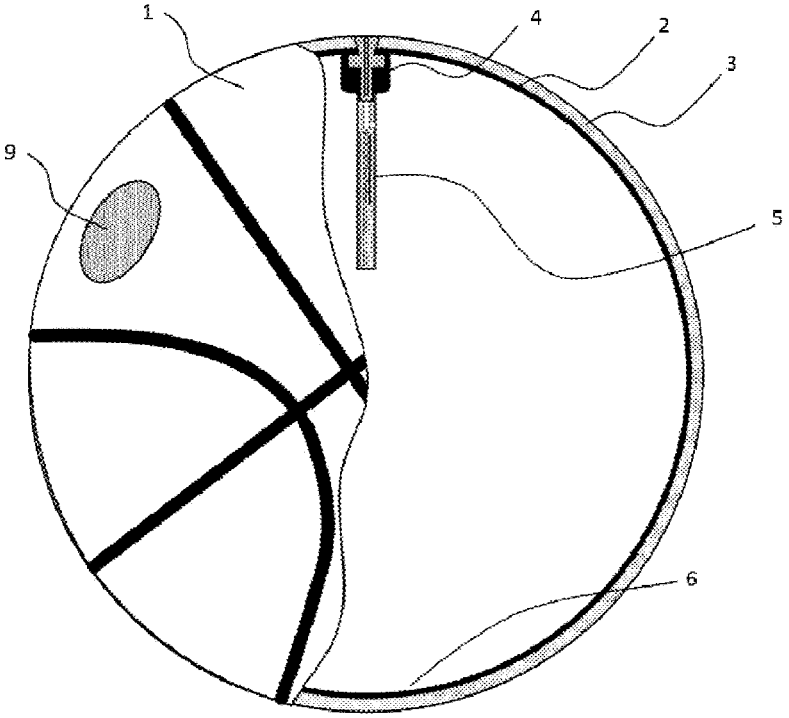
FIG. 5 shows the combined exterior and cross section of a sports ball fitted with an exemplary embodiment of a low-profile electronics package.

In order to instrument a conventional ball with the electronics package 5 or a foldable, corner-cube RF reflector, the entire package 5 must fit through the valve opening in the valve retention section 4. Similarly a reflective coating spray head must fit through such opening in order to apply the coating to the inside surface of the bladder 2. Optionally, the opening may be temporarily expanded by using a retractor, similar to a Kolbel retractor (Becton, Dickinson and Company, Franklin Lakes, New Jersey) used by surgeons or other similar device for expanding an opening. A typical valve opening is about 6.5 mm in diameter, which may be expanded through stretching an oval to about 12 mm. In addition to the RF chip antenna 17, the electronics package 5 has a number of electronics components 16. These may include some or all of the following as well as various other components not listed: a microprocessor or microcontroller, an RF signal generating chip (such as the Decawave DW1000—Dublin, Ireland), an accelerometer, a vibration switch, a tilt switch, an altimeter, a digital compass, voltage regulation, clock signal generation, energy harvesting components, supercapacitors and batteries 13. All of these components are available in packages that are 6 mm or less in width. So called coin cell batteries are available in a wide variety of sizes, several of which are small enough to fit through the valve opening including the SR64, which is 5.8 mm in diameter and the SR66 which is 6.8 mm in diameter. A variety of other batteries may also be appropriate. Each coin cell is typically about 1.5 volts, so two in series are necessary to supply the voltage for 3 volt DC electronics. Additional batteries in parallel may be added to extend battery life of the system. One configuration of three parallel sets of battery pairs 13 is shown in FIG. 3 where one end of the batteries 13 is in contact with two different conductors (anode and cathode) on the circuit board 14 and a metal contact strip 15 is used to tie together the other ends of the batteries 13. Other configurations where the axes of the coin cells 13 are collinear are also possible.

Because RF transmissions and receptions are only required when the basketball is in use and actively moving, bouncing, spinning, etc., it is possible to use an energy harvesting system in lieu of or in combination with a conventional battery. Energy harvesting systems have commonly been used in "shake" flashlights (for example model DA84170 form Klenck Tools, Canton, OH), as well as a number of wireless devices. In these systems, some form of electricity generation (from changing magnetic fields across a conductive coil, piezo crystal strain, etc.) is used to charge an energy storage system (battery or capacitor) for later use. Dribbling, tossing, catching, shooting and bouncing a ball off a goal or backboard can all create sufficient acceleration within the ball to allow an energy harvesting system to charge an energy storage system (capacitor or a rechargeable battery). When no motion is sensed by the motion detection system within the ball after some period of time, the electronics may be put to sleep to conserve power and the frequency of RF transmissions may be curtailed or stopped. When motion is once again detected by the motion detection system, RF transmissions can be re-initiated and if energy harvesting is being used, power may once again be generated from the motion. The energy harvesting system may also be used to detect motion without the use of a separate motion detection system by detecting when it is generating power.

If the location of the center of mass of the entire electronics package 5 does not correspond to the center of mass of the uninstrumented ball 1, the ball will be out of balance. In other words, the total center of mass will not be coincident with the center of the spherical ball shape and the ball will spin with a wobble when tossed. To correct this and balance the ball 1, material 6 may be added inside the bladder at a location that is opposite the valve 7. This may be accomplished by either gluing a solid object to the bladder 2 or by injecting a curable liquid material through the valve hole and letting it cure on the side of the bladder that is opposite the valve 7. The material may also be comprised of metal powders or other materials to enhance RF signal reflectivity. To balance the ball, the mass of the material 6 added should equal the mass of the electronics package times the ratio of the distance from the ball center to the electronics package 5 center of mass and the distance from the ball center to the added material 6 center of mass.

In order for players to readily identify one instrumented ball from another, an easily identifiable, unique mark 9 such as alphanumeric characters, graphical symbols, moniker, textures, or color badges may be added to the ball's exterior. In a preferred embodiment, each ball 1 used on the same court would have a different color badge 9 attached to its exterior. When the instrumented valve assembly 5 is assembled to the ball 1, the unique code it transmits through RF to identify itself is known and correlated to the unique exterior mark 9 on the ball. Thus, during use, a remote computational system 30 will know that the say blue-marked ball transmits through RF a particular identification code that is different from say the yellow-marked (or any other) ball.

When used during a shooting practice session, where say three players are shooting at a single goal, each player's performance may be individually tracked and recorded. At the beginning of the session, the players must agree on ball assignments and communicate those to the remote computational system 30. For example, player 1 uses the blue-marked ball, player 2 uses the yellow-marked ball and player 3 uses the red-marked ball. When the system determines that a shot was taken based either from the signal form a performance monitoring system 27 or from the reckoning data from a ball 1, it can determine the identity of the ball that was shot based on the transmitted RF code of the ball most proximate the goal. If the code corresponding to say the red-marked ball was received, the system knows that the results of that shot should be attributed to player 3. Similarly, when the system determines that a shot was taken based on the transmitted RF code corresponding to say the blue-marked ball, it knows that the results of that shot should be attributed to player 1, etc. Although signals from a plurality of balls may be received during a shooting session, only the ball proximate the goal is attributed with the shot. If a plurality of balls are proximate the goal, then additional information such as the ball height above the court or the trajectory of the ball just prior to the shot being registered may give additional information as to which ball the shot should be attributed. The remote computational system 30 collects such shooting statistics for the individual players and records them in a database for later review.

To monitor the position of one or more balls 1 on a court, the court is instrumented with a plurality of RF antennae 25 that are spaced around its periphery. This may include locations on the floor, on the goal or backboard, on walls, suspended from the ceiling, etc. Although there is some flexibility in where antennae may be located, they should generally be fixed in dispersed stationary locations during the course of play. To avoid mathematical singularities, at least one of three or more antennae should not be collinear and at least one of four or more should not be coplanar. These antennae are in wired or wireless communication with a remote computational device 30, either directly or relayed through one another. Each antenna may also include a separate microprocessor to control incoming and outgoing signals. The remote computational device 30 may be a smart phone, a tablet computer, a laptop computer, a microprocessor or any other computational device that has sufficient compute power to both communicate with the antennae and compute ball locations from the received antennae signals. The calculation of ball locations may also be performed in whole or part by microprocessors that may be located proximate the antennae. The remote computational device 30 may also be in communication with a database that can store data for later review and editing. Wireless communication amongst the various devices may be through Bluetooth, Wi-Fi, IEEE 802.11, or any other RF, optical or acoustic protocol. The goal 26 is fitted with a performance monitoring system 27 that can detect when a ball/goal interaction has occurred, which places the ball close to the goal 26. The performance monitoring system 27 is also in wired or wireless communication with the same or a separate remote computational device 30.

During a shooting session, the RF antennae 25 are continuously monitoring the position of all balls 1 on the court preferably at a rate between 2 and 40 Hertz and more preferably between 10 and 20 Hertz and sending signals to the remote computational device 30; however, most of the data received by the remote computational device does not contribute to determining the location of the player position for a shot and therefore may be ignored. Such data is only relevant when a shot trigger event occurs. A shot trigger event may be the detection of a ball/goal interaction by the performance monitoring system 27 or the calculation of a ball location by the ball location reckoning system that is proximate the goal 26 within some threshold distance. A shot trigger event means that a shot was likely taken by a player and once it occurs, the antennae 25 signal data that were received within a time window prior to the trigger event are analyzed in order to determine the initial location of the shot. If a shot trigger event was generated by the performance monitoring system 27, the data corresponding to each ball 1 are analyzed by the remote computational device 30 to determine which ball is closest to the goal and likely caused the trigger event. Once determined, the data from the identified ball are analyzed to determine which points lie along a ballistic arc 28. This may be accomplished by starting with the point just prior to the trigger event and adding each additional point backwards in time until a point no longer fits closely to a ballistic arc 28. The last point (first point in time) that fits the arc is an approximation of the location of the ball when the shot was initiated. The calculation for how closely a set of points fit the ballistic arc may be performed in 3D space by fitting the points to a parabola or in 2D space by fitting the points to a line. Not only do points have to fit to proscribed curves in Cartesian space, but they must also fit proscribed curves in distance versus time space. This means for points that lie on the arc, calculated vertical distances should be a quadratic function of time and calculated horizontal distance should be a linear function of time.

The advantage of combining the sensing within a performance monitoring system 27 and the position reckoning within a player positioning system is that the data analysis of player positions during shooting events are greatly simplified. Without knowledge of the occurrence of a shooting event from a performance monitoring system 27, many thousands of player position data points would need to be analyzed to determine which are likely to correspond to a player's position at the time of a shot towards a goal. This would be highly error prone, as players may not execute readily identifiable position patterns prior to shooting. Since a performance monitoring system 27 establishes a triggering event has occurred (through ball impact or goal detection) and the time that such an event occurred, this may be used to select the appropriate player position data without excessive analysis.

Since a performance monitoring system 27 measures the time of a triggering event, the player's release time for the shot (and therefore his shooting position on the court) must be inferred, rather than the time measured directly. For example, the player position data recorded between 0.5 and 2 seconds (or less than 3 seconds) prior to the triggering event may be isolated and analyzed for a pause in horizontal position changes and/or an increase then decrease in vertical position signaling a jump for a shot attempt. Since the time window where a shot was taken may be relatively narrow due to the use of a performance monitoring system 27, video captured by a mobile device may also be analyzed to detect the time when the shooter released the ball for the shot. This enables the selection of at least one location measured by the player positioning system that corresponds in time to the time determined by a video analysis which detects a ball's release from the shooter's hands.

For either a ball or player positioning system, the system must first be calibrated to the court where it is being used. For a system with fixed transmitter/transponders or locators permanently affixed around a court, a calibration need only occur once, upon installation. For the more general case where a system is transportable, for example, is contained within a mobile device that is brought to a court each time it is used, a new calibration must be done upon each court visit. The following procedure is described for a player positioning system, where a smart phone 30 is used to track a single tag 35 that is affixed to a player's shoelaces on his/her shoe 36, but one skilled in the art will understand that the procedure is generalizable to either a ball or player positioning system with multiple tags, fixed or movable transponders, etc.

We assume that the phone 30 used for tracking is placed adjacent to the court and remains fixed during all tracking activities. Once the phone position is established in the desired location on the court (so that it may for example also capture video of the players), it needs to be calibrated so that its position and orientation 33 relative to the court and basket 40 are known. Due to the orientation of the internal UWB chip 31 within the phone 30, manufacturers recommend the back of the phone face the volume of play where the player is likely to be.

Figure 6:
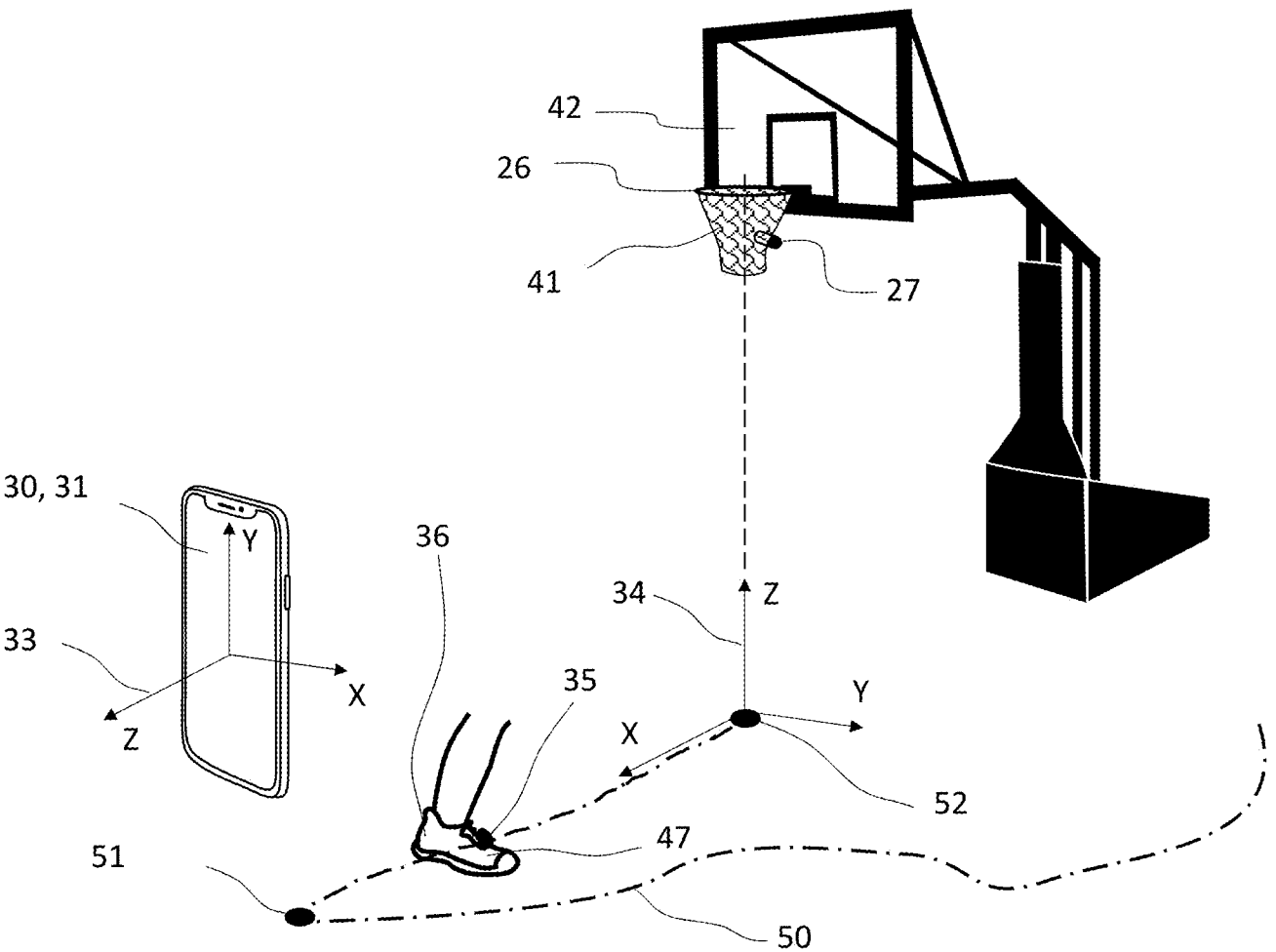
FIG. 6 shows an embodiment of a player position reckoning system.

To perform the calibration is as simple a manner as possible, the following assumptions are made:

A Cartesian coordinate system 34 for the court is established as shown in FIG. 6, where the origin is on the court floor directly below the center of the goal 40, the X axis is perpendicular to the plane of the backboard 42, the Y axis is coplanar to the backboard 42 and the Z axis is vertical.

The phone 30 remains in a fixed position during both the calibration and all shooting drills. The phone's on-board accelerometer, magnetometer, and gravity vector sensing may be used to confirm its stability. Additionally, the phone's camera may also be utilized to help confirm its stability through changes in captured images of the environment.

The phone 30 is able to measure the gravity vector relative to its orientation.

The performance monitoring system 27 may be used by the player to signal the phone 30 that the player's foot 36 is in a position under the rim 26 and the calibration may be initiated. It therefore allows the player to trigger the phone 30 to make measurements without the need to approach or touch the phone 30.

The tracked motion of a player 36 wearing a tag 35 may be used to help establish the court coordinate system 34. The following simple procedure is an example of what may be used to facilitate calibration of the relative position and orientation between the phone coordinate system 33 and the court coordinate system 34. An advantage of having a performance monitoring system 27 attached to the net 41 is that a player can create a triggering event used to establish the capture of the position of the player at a prescribed court location for the purpose of calibration and without needing to interact with the phone directly. The phone 30 receives a constant feed of direction and distance data from the tag 35 as the player walks along a trajectory/path 50:

A) The player is instructed to stand at a point near the foul line 51, whose precise distance from the rim is not critical, with a ball 1 in hand and with his foot 36 with the tag 35 laterally centered on the court (in line with the goal 26 center). B) The player then walks toward the goal 26, keeping the tag 35 approximately centered on the court. C) The player should stop with the tag 35 at a point 52 directly under the goal 26 center. D) Without moving his/her feet 36, the player should gently throw the ball 1 against the performance monitoring system 27 thereby triggering the vibration sensors onboard.

In the meantime, the phone 30 executes the following calibration procedure to measure the court coordinate system 34 relative to the phone coordinate system 33: A) The phone 30 displays the calibration instructions to the player, requests the phone 30 be located in a fixed position and asks the player to initiate calibration by tapping a button on the screen and not touch the phone again. B) The phone 30 continuously collects tag 35 data in a circular buffer that continuously updates and keeps the several seconds of data. This includes all points that the player's foot 36 traces along path 50 and may include points before he/she arrives at the point near the foul line 51. C) Upon receiving a vibration message from the performance monitoring system 27, the phone 30 stops collecting data to the buffer. D) The last data point in the buffer, point 52 directly under the goal 26 center, establishes the origin of the court coordinate system. E) The data in the buffer is used to fit a line 70. Initially, a data segmentation algorithm, such as a Hough transform (U.S. Pat. No. 3,069,654), may be used to segment the data into points that are likely to lie in a single straight-line segment emanating from the point 52 under the goal 26 center and extending down the center of the court towards the foul line. This can eliminate most points in path 50 that were recorded prior to the user arriving at the point near the foul line 51 and are far from the straight line 70. F) The data points within the highest population clusters are used to calculate a least squares line. This might need to be iterative in order to eliminate any outlier points (points that are far from the fitted line are eliminated and the line parameters are recalculated without those points). F) A unit vector along the least squares line that emanates from point 52 establishes the court X axis. G) The normalized vector cross product between the court X axis the phone's gravity vector establishes the court Y axis. H) The normalized vector cross product between the court X and Y axes establishes the court Z axis.

One skilled in the art will understand that the above procedure is generalizable to any path the user traces on the court, not just a straight-line segment from the center of the foul line to under the basket. It is also generalizable to a mobile device that may measure objects in its environment through optical capture and analysis. For example, augmented reality algorithms use the detection and orientation of environmental features such as lines and planar objects, for example, the floor, a backboard, a rim, etc., in a camera's field to fix coordinate systems.

The mobile device's gravity vector and magnetometer readings are also recorded, which can help to re-establish phone orientation if it is moved. Additionally, images from the mobile device's camera may also be utilized to help to re-establish phone orientation.

Figure 7:
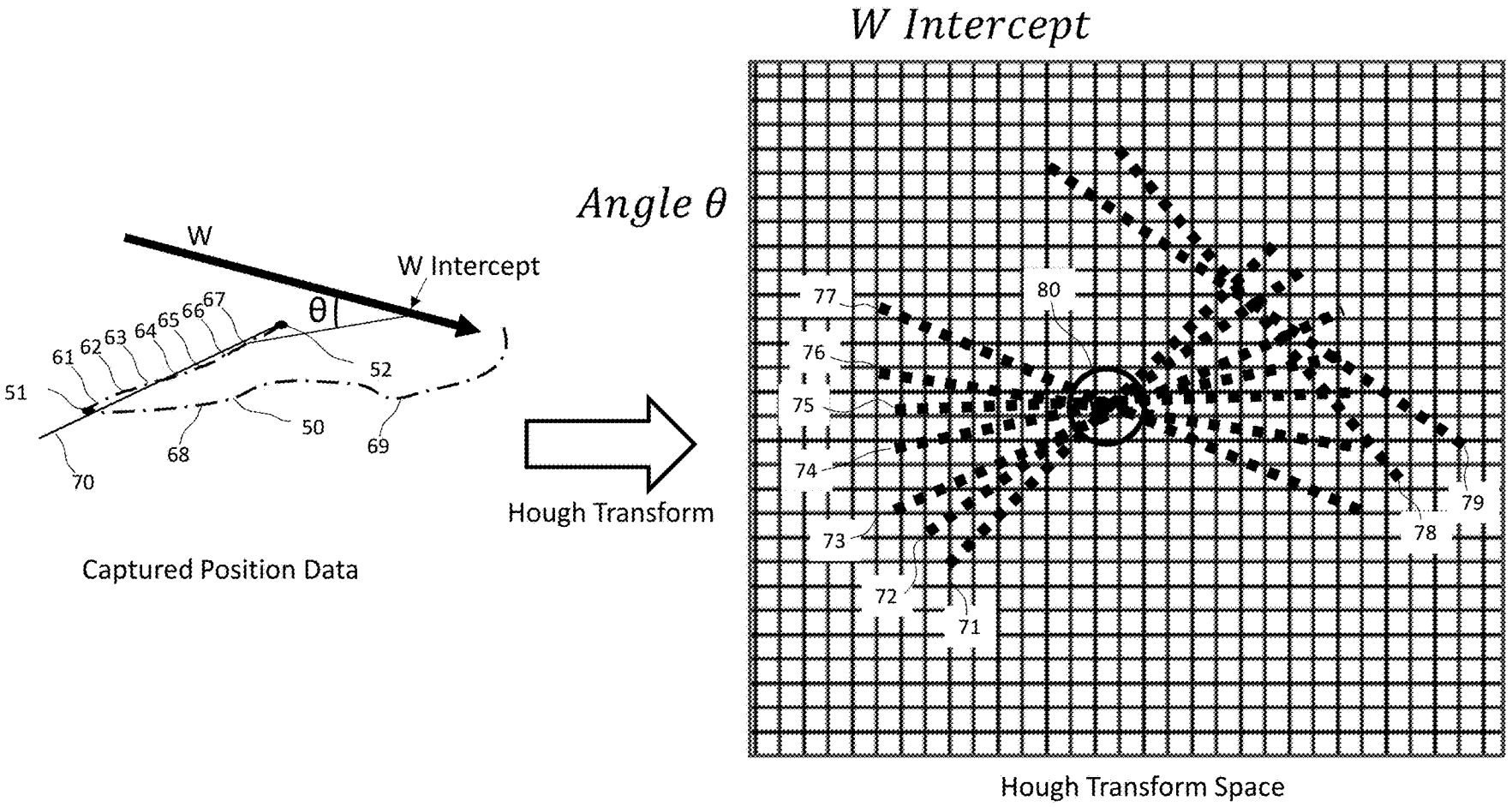
FIG. 7 a plurality of points from a player's path plotted in Hough transform space.

An example Hough transform segmentation is illustrated in FIG. 7, where nine points (61 through 69) along the path 50 are plotted as corresponding curves (71 through 79) in Hough transform space of angle theta and W intercept, where W is an arbitrary axis in space. The angle and W intercept for point 67 is shown, for example, in FIG. 7. The Hough transform space is partitioned into a finite number of values and each curve that passes over a partition casts a "vote" for that partition. After all curves have been plotted in the space, the values for the partitions with the greatest number of votes 80 are the most likely parameters for a line 70 that passes near the most points that correspond to the curves. This allows the system to eliminate points that had no corresponding votes in the high-vote partitions 80, as they are unlikely to lie near the maximum likelihood line 70. In the example in FIG. 7, points 68 and 69 generate corresponding curves 78 and 79 that do not have votes in the high-vote partitions 80, so they are eliminated from further calculations.

Once a calibration of the court coordinate system 34 relative to the mobile device coordinate system 33 has been established, the mobile device 30 will be able to measure positions relative to the court. In order to track a player moving about the court, the mobile device continuously performs coordinate transformations between the tag 35 location relative to the device coordinate system 33 (constantly streaming to the device from the tag 35) to the coordinate system of the court 34 using the previously calibrated device/court calibration.

To facilitate a measurement of the shooter's location when a shot is executed, the performance monitoring system 27 may be used to help select which tag location should be associated with a shot. The triggering event time as measured by the performance measuring system 27 may be used to help measure player position at the time of a shot; however, there is an offset in time between the release of the ball (player shooting position) and the ball impact (triggering event) as measured by the performance monitoring system 27. When the player remains at the same court location for some time before and after releasing the ball for a shot, then we can assume that his/her location, between 0.5 and 2 seconds prior to the detected ball impact, will be a good measurement of shot location. However, if the player is executing a ball handling maneuver or a layup, then his/her location seconds prior to ball impact may not be a good indication of where he/she released the ball. If the tag direction and distance measurements are sufficiently precise, it may be possible to determine that the ball was released when there was an up and down tag motion off the floor prior to ball impact. If several up and down motions are measured, then the closest in time to the ball impact time (as long as it comes before the impact time) is likely the best to choose.

Once a ball impact (triggering event) time is established, the mobile device needs to capture a shooting position for the shot. The mobile device will be receiving a constant stream of tag position data during a session, but only the data in close chronological vicinity of the triggering even are pertinent. Thus, the mobile device should continuously collect tag distance, direction and time data in a circular buffer that keeps the last say 3 seconds of data. Once a triggering event message is received from the performance monitor, the data collection should be paused, and the data contained within the circular buffer should be analyzed to determine appropriate shooting location as follows:

A) Tag location data should be analyzed to determine if there is a pause in X,Y (horizontal) location during which there is an increase in Z location, indicating a jump during a shot. B) If multiple such pauses are present, then the one closest to the ball impact time should be used. One scenario that might produce this is the player jumps for a rebound of his previous shot, then shortly thereafter shoots a layup shot. C) Tag data collection should be re-initiated into a different circular buffer shortly after the impact message, as although it might take a while for a player to retrieve a ball to take the next shot, the system needs to allow for multiple balls being used and a quick succession of shots. Thus, two circular buffers should be established, and data alternatively fed into them each time an impact is sensed.

It is apparent that there has been provided in accordance with the present invention a position reckoning system which fully satisfies the objects, means and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. A shooter localization system comprising:

at least one shooting position on a court whose position may be measured by a player localization system;

at least one ball;

at least one goal;

at least one performance monitoring system that measures interactions of said at least one ball and said at least one goal;

at least one player localization system that measures the shooting position relative to a location of at least one of said at least one goal;

a remote computational system that receives data from both said at least one performance monitoring system and said at least one player localization system; and a triggering event comprising a signal from said at least one performance monitoring system, wherein said triggering event indicates the time at which a ball/goal interaction was detected; wherein said triggering event is used by said remote computational system to select a subset of said data collected from said at least one player localization system that was obtained at or just prior to said triggering event and use said subset of said data collected for calculations.

2. The shooter localization system according to claim 1, wherein said calculations include the shooting position upon releasing one of said at least one ball for a shot.

3. The shooter localization system according to claim 2, wherein said calculations include a trajectory of the at least one ball shot from one of said at least one shooting position.

4. The shooter localization system according to claim 1, wherein said subset of data is data that precedes said triggering event by less than three seconds.

5. The shooter localization system according to claim 1, wherein said player localization system is comprised of a single mobile device utilizing ultra-wide-band radio.

6. The shooter localization system according to claim 1, wherein said triggering event is used to establish a capture of the shooting position at a prescribed location on said court for the purpose of calibration.

7. The shooter localization system according to claim 1, wherein said player localization system is calibrated to a location of said court by measuring the at least one shooting position as said at least one shooting position moves through a prescribed path relative to said court.

8. The shooter localization system according to claim 7, wherein at least a portion of said prescribed path is a line segment.

9. The shooter localization system according to claim 8, wherein a Hough transform is utilized in a portion of said calibration.

10. The shooter localization system according to claim 8, wherein said calibration utilizes a coordinate system comprised of one axis parallel to said line segment and another axis parallel to a gravity vector measured by said remote computational system.

11. The shooter localization system according to claim 8, wherein said calibration utilizes a coordinate system established using environmental features detected in remote-computational-system-camera images.

12. A method for determining a position of at least one shooter on a court, wherein the method comprises:

a. measuring a position of at least one shooter relative to a goal on said court by use of a player localization system;

b. using a triggering event comprising a signal from at least one performance monitoring system, wherein said triggering event indicates a time at which a ball/goal interaction was detected;

c. measuring a sequential series of locations of said at least one shooter by said player localization system whose measured position just prior to said triggering event is proximate said goal;

d. calculating coordinates of a shooting location from said series of locations in step c.

13. The method in claim 12 for determining the position of at least one shooter on a court, wherein said shooting location of each associated shooter is used to calculate goal and miss statistics from multiple shots at an assigned position.

14. The method in claim 12 for determining the position of at least one shooter on a court, wherein said prior to said triggering event is within 3 seconds.

15. The method in claim 12 for determining the position of at least one shooter on a court, wherein said calculating includes selection of locations where a vertical increase then decrease has occurred.

16. The method in claim 12 for determining the position of at least one shooter on a court, wherein said calculating includes a selection of locations where a pause in horizontal positional changing has occurred.

17. The method in claim 12 for determining the position of at least one shooter on a court, wherein said calculating includes a selection of at least one of said locations corresponds in time to the time determined by a video analysis which detects a ball's release from said at least one shooter's hands.

* * * * *